US007321741B2

(12) United States Patent
Sakamaki et al.

(10) Patent No.: US 7,321,741 B2
(45) Date of Patent: Jan. 22, 2008

(54) IMAGE FORMING APPARATUS FEATURING A TRANSPARENT IMAGE FORMING STATION TO ACHIEVE UNIFORM GLOSS

(75) Inventors: Tomoyuki Sakamaki, Toride (JP); Hiroyuki Kidaka, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 253 days.

(21) Appl. No.: 11/295,505

(22) Filed: Dec. 7, 2005

(65) Prior Publication Data

US 2006/0127134 A1 Jun. 15, 2006

(30) Foreign Application Priority Data

Dec. 13, 2004 (JP) ..... 2004-360032

(51) Int. Cl.
*G03G 15/01* (2006.01)
*G03G 15/24* (2006.01)

(52) U.S. Cl. ..... 399/150; 399/223

(58) Field of Classification Search ..... 399/149, 399/150, 223
See application file for complete search history.

(56) References Cited

U.S. PATENT DOCUMENTS 6,941,095 B2 9/2005 Kidaka ..... 399/149

FOREIGN PATENT DOCUMENTS

| | | | |
|---|---|---|---|
| JP | 10-247036 | | 9/1998 |
| JP | 2000-147863 | | 5/2000 |
| JP | 2002-214871 | | 7/2002 |
| JP | 2003107836 A | * | 4/2003 |
| JP | 2003162125 A | * | 6/2003 |

* cited by examiner

*Primary Examiner*—David M. Gray
*Assistant Examiner*—Ryan Gleitz
(74) *Attorney, Agent, or Firm*—Fitzpatrick, Cella, Harper & Scinto

(57) ABSTRACT

An image forming apparatus includes a plurality of image forming stations and a transferring device. Each image forming station includes an image carrier for carrying an electrostatic image and a developing device for developing the electrostatic image with toner. The transferring device transfers toner images formed by the plurality of image forming stations to a transferring medium. The plurality of image forming stations include a transparent image forming station using transparent toner and color image forming stations using, for example, yellow, magenta, cyan, and black toners, respectively. The transparent image forming station includes a cleaning device that is in contact with the image carrier and picks up residual toner on the image carrier. The developing devices of the color image forming stations develop electrostatic images on the corresponding image carriers and simultaneously pick up residual toners on the corresponding image carriers.

10 Claims, 11 Drawing Sheets

IMAGE FORMING APPARATUS FEATURING A TRANSPARENT IMAGE FORMING STATION TO ACHIEVE UNIFORM GLOSS

BACKGROUND OF THE INVENTION

1. Field of the Invention

The present invention relates to an image forming apparatus that forms an image by an electrophotographic method, and more specifically, it relates to an image forming apparatus, for example, a photocopier, a printer, a facsimile, or a multifunctional machine.

2. Description of the Related Art

The steps involved in forming a color image by the color electrophotographic method will be described. A color image to be formed is separated into different images with a red, green, and blue filter. The surface of an image carrier is charged and is then exposed to light to form an electrostatic latent image on the surface of the image carrier. A toner image is then formed with a toner and is then transferred to a transferring member. This process is repeated to form a color toner image on the transferring member. The color toner image is then transferred to a recording sheet. The recording sheet is then heated and pressed to fix the color toner image to the surface of the recording sheet.

The toner layer in the deep color parts of the color toner image has a large thickness because a plurality of color toners are superposed. In contrast, the toner layer in the light color parts of the color toner image has a small thickness. Especially, the white background parts have no toner layer.

Consequently, the height of the top layer of the image differs depending on color density. The deep color parts have a gloss as if painted in oil color. In contrast, the light color parts, especially the white background parts hardly have a gloss. Therefore, the gloss of the entire image area is uneven.

To solve the above-mentioned problem, Japanese Patent Laid-Open No. 2000-147863 (see FIG. 10) proposes to place transparent toner in the parts where the amount of color toners is small and the thickness of toner layer is small. Since the thickness of toner layer is substantially equalized throughout the color image, the irregularity of the surface of the color image is eliminated, and therefore the color image has a uniform gloss.

The total amount of toner per unit area, that is to say, the sum of the amount of color toners containing colorant and the amount of transparent toner hardly containing colorant per unit area, is uniform throughout the image. Therefore, the uniformity of gloss throughout the image is improved.

As an example of a color image forming apparatus using such transparent toner, a so-called tandem-type image forming apparatus is known. This tandem-type image forming apparatus includes a plurality of image carriers for forming different color toner images, and is discussed in, for example, Japanese Patent Laid-Open No. 2002-214871. The plurality of image carriers are arranged tandemly along a moving direction of an intermediate transferring belt. Each image carrier is provided with a charging device, an exposing device, and a developing device, which form a toner image on the image carrier. The color toner images formed on the image carriers are sequentially transferred to and superposed on the intermediate transferring belt (first transfer). The superposed toner images are then transferred to a transferring sheet (second transfer). After a subsequent fixing process, a color image is obtained.

Methods for removing residual toner on the image carrier will now be described. Hitherto, residual toner on the image carrier has been removed mainly by bringing a cleaner into contact with the image carrier. The cleaner is, for example, a brush cleaner formed of fibrous material or a blade formed of an elastomer (e.g., polyurethane rubber). However, this method has the following problem. Since the cleaner is in contact with the image carrier, the image carrier is gradually abraded with use, and therefore the life of the image carrier is short.

To solve this problem, an electrophotographic method that does not use a cleaner (cleanerless method) is proposed.

The cleanerless method has been recently developed in order to miniaturize image forming apparatuses and reduce waste toner. The image forming apparatus using this method has no cleaners. The residual toner on the photoconductor is picked up by the developing device at the same time as development, stored in the developing device, and reused. An example of a cleanerless system using charging rollers is given in Japanese Patent Laid-Open No. 10-247036.

In an above-described tandem-type image forming apparatus, the so-called "retransfer" can occur. That is to say, a toner transferred from an image carrier to the intermediate transferring belt can then adhere to another image carrier on the downstream side in the moving direction of the intermediate transferring belt. In the case where the tandem-type image forming apparatus has cleaners, if a toner is retransferred to a downstream-side image carrier, the extraneous unwanted toner is picked up by the cleaner and therefore is not mixed into another toner stored in the developer. However, in the case where the tandem-type image forming apparatus has the cleanerless structure, of course, the apparatus has no cleaners. A retransferred toner is picked up by the developing device, and therefore color mixing (toner mixing) can occur.

When transparent toner is used in order to equalize the total amount of toner per unit area throughout an image, the transparent toner is placed mainly in the non-image part. If color toners are mixed into the transparent toner stored in the developing device, the color toners are placed in the non-image part. This is the same as the so-called "fog." In extreme cases, this causes a defect in the image.

SUMMARY OF THE INVENTION

The present invention provides an image forming apparatus including a transparent image forming station and color image forming stations. In the transparent image forming station, no color mixing occurs. The image carrier of the transparent toner station has a long life.

In an aspect of the present invention, an image forming apparatus includes a plurality of image forming stations and a transferring device. Each image forming station includes an image carrier for carrying an electrostatic image and a developing device for developing the electrostatic image with toner. The transferring device transfers toner images formed by the plurality of image forming stations to a transferring medium. The plurality of image forming stations include a transparent image forming station using transparent toner and color image forming stations using, for example, yellow, magenta, cyan, and black toners, respectively. The transparent image forming station includes a cleaning device that is in contact with the image carrier and picks up residual toner on the image carrier. The developing devices of the color image forming stations develop electrostatic images on the corresponding image carriers and simultaneously pick up residual toners on the corresponding image carriers.

Further features of the present invention will become apparent from the following description of exemplary embodiments with reference to the attached drawings.

DESCRIPTION OF THE EMBODIMENTS

The image forming apparatus of the present invention will now be described in detail. The size, material, and shape of components and relative position of components of the image forming apparatus do not limit the present invention unless otherwise stated.

The embodiments of the present invention will be described in detail with reference to the drawings.

Embodiment 1

Figure 1:
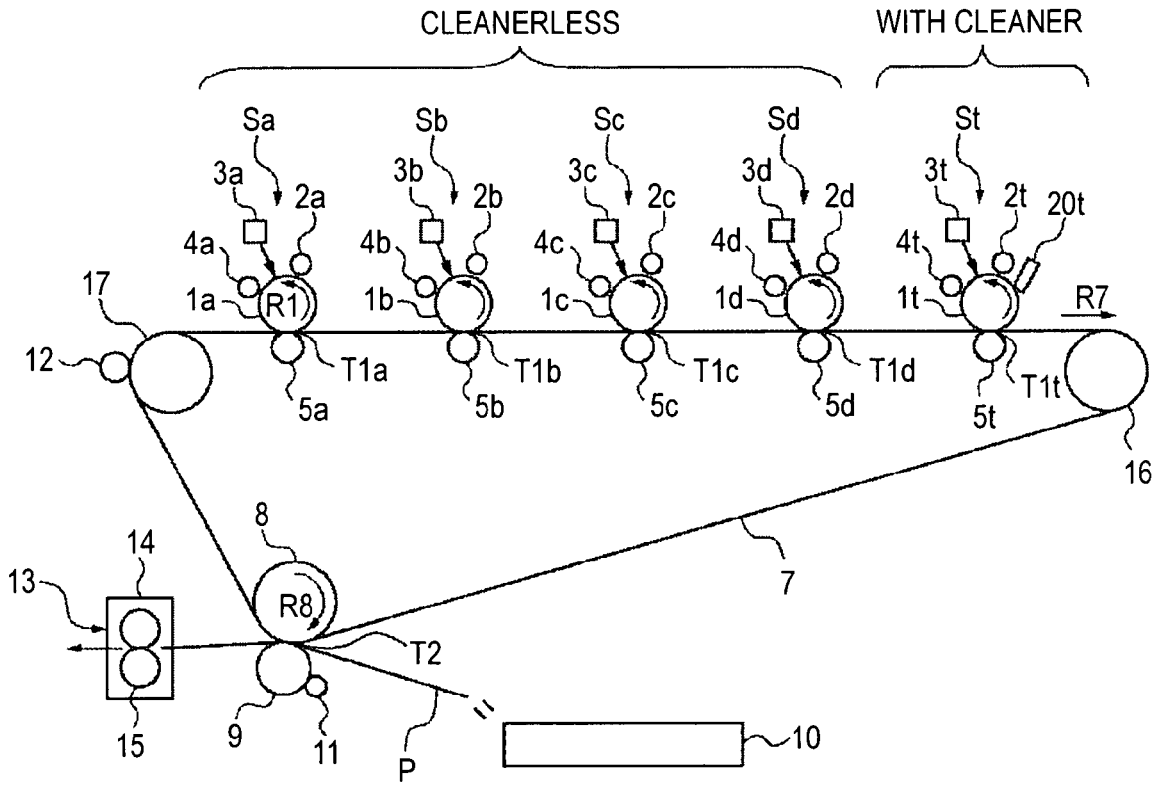
FIG. 1 illustrates an image forming apparatus according to an embodiment of the present invention.

FIG. 1 is a schematic sectional view of a full-color image forming apparatus according to embodiment 1. This apparatus is a complex apparatus having the functions of a photocopier, printer, and facsimile.

The image forming apparatus shown in FIG. 1 has five image forming stations Sa, Sb, Sc, Sd, and St, which are arranged in this order in the direction of rotation of an intermediate transferring belt 7 (in the direction of arrow R7).

The image forming stations Sa, Sb, Sc, and Sd form yellow, magenta, cyan, and black toner images, respectively. The image forming station St forms a transparent toner image. The image forming stations Sa, Sb, Sc, Sd, and St have drum-shaped electrophotographic photoconductors (hereinafter referred to as "photoconductor drum") 1*a*, 1*b*, 1*c*, 1*d*, and 1*t*, respectively. The photoconductor drums serve as image carriers.

The photoconductor drums 1*a*, 1*b*, 1*c*, 1*d*, and 1*t* rotate in the direction of arrow R1 (counterclockwise in FIG. 1). Charging devices 2*a*, 2*b*, 2*c*, 2*d*, and 2*t*, exposing devices 3*a*, 3*b*, 3*c*, 3*d*, and 3*t*, developing devices 4*a*, 4*b*, 4*c*, 4*d*, and 4*t*, and first transferring rollers 5*a*, 5*b*, 5*c*, 5*d*, and 5*t* are disposed around the photoconductor drums 1*a*, 1*b*, 1*c*, 1*d*, and 1*t*, respectively. In each image forming station, the charging device, the exposing device, the developing device, and the first transferring roller are arranged in this order in the direction of rotation of the photoconductor drum. The endless intermediate transferring belt 7 is stretched around the first transferring rollers 5*a*, 5*b*, 5*c*, 5*d*, and 5*t*, a second transferring opposed roller 8, and tension rollers 16 and 17. The intermediate transferring belt 7 is pressed by the first transferring rollers 5*a*, 5*b*, 5*c*, 5*d*, and 5*t* against the photoconductor drums 1*a*, 1*b*, 1*c*, 1*d*, and 1*t*. Thereby, first transferring nips T1*a*, T1*b*, T1*c*, T1*d*, and T1*t* are formed between the intermediate transferring belt 7 and the photoconductor drums 1*a*, 1*b*, 1*c*, 1*d*, and 1*t*, respectively. The intermediate transferring belt 7 rotates in the direction of arrow R7 with the rotation of the second transferring opposed roller 8, which also serves as a driving roller. The rotating velocity of the intermediate transferring belt 7 is set to be substantially the same as the rotating velocity (processing speed) of the photoconductor drums 1*a*, 1*b*, 1*c*, 1*d*, and 1*t*.

A second transferring roller 9 is disposed opposite the second transferring opposed roller 8. The intermediate transferring belt 7 passes between the second transferring roller 9 and the second transferring opposed roller 8. A second transferring nip T2 is formed between the second transferring roller 9 and the intermediate transferring belt 7. An intermediate transferring belt cleaner 12 presses the intermediate transferring belt 7 against the tension roller 17.

Transferring sheets P on which images are formed are stacked in a sheet feeding cassette 10. The transferring sheets P are supplied to the second transferring nip T2 one at a time by a sheet feeding device including sheet feeding rollers, sheet conveyance rollers, register rollers, and so on (not shown). A fixing unit 13 is disposed on the downstream side of the second transferring nip T2 in the path of the transferring sheets P. The fixing unit 13 includes a fixing roller 14 and a pressing roller 15 pressing against the fixing roller 14. A discharged-sheet tray (not shown) is disposed on the downstream side of the fixing unit 13.

How the image forming apparatus forms a full-color image on a transferring sheet P will be described.

First, a document is read, and first image signals for forming yellow, magenta, cyan, and black toner images are determined. Next, on the basis of the values of the first image signals, a second image signal for forming a transparent toner image is determined. In the present embodiment, the amount of transparent toner is determined on the basis of the integrated value of the first image signals. Next, the photoconductor drums 1*a*, 1*b*, 1*c*, 1*d*, and 1*t* are rotated by a motor (not shown) in the direction of arrow R1 at a predetermined processing speed, and uniformly charged at a predetermined polarity and potential by the charging devices 2*a*, 2*b*, 2*c*, 2*d*, and 2*t*, respectively. After being charged, the photoconductor drums 1*a*, 1*b*, 1*c*, 1*d*, and 1*t* are exposed by the exposing devices 3*a*, 3*b*, 3*c*, 3*d*, and 3*t*, respectively, on the basis of image information. The charge is removed partly, and an electrostatic latent image is formed on each photoconductor drum.

The electrostatic latent images on the photoconductor drums 1*a*, 1*b*, 1*c*, 1*d*, and 1*t* are developed by the developing devices 4*a*, 4*b*, 4*c*, 4*d*, and 4*t* into yellow, magenta, cyan, black, and transparent toner images. These five toner images are transferred onto the intermediate transferring belt 7 one over another at the first transferring nips T1*a*, T1*b*, T1*c*, T1*d*, and T1*t* by the first transferring rollers 5*a*, 5*b*, 5*c*, 5*d*, and 5*t*, respectively (first transfer). In this way, the five toner images are superposed on the intermediate transferring belt 7.

The five toner images superposed on the intermediate transferring belt 7 are then transferred to the transferring sheet P (second transfer). The transferring sheet P is brought to the second transferring nip T2 by the sheet feeding device from the sheet feeding cassette 10. The register rollers align the leading edge of the transferring sheet P with the leading edge of the toner images on the intermediate transferring belt 7. At the second transferring nip T2, the five toner images on the intermediate transferring belt 7 are transferred all together onto the transferring sheet P by the second transferring roller 9 (second transfer). When the second transfer is carried out, the toner not transferred to the transferring sheet P and remaining on the intermediate transferring belt 7 (residual toner) is removed by the intermediate transferring belt cleaner 12.

On the other hand, the transferring sheet P with the five toner images is conveyed to the fixing unit 13. The fixing unit 13 applies heat and pressure to the transferring sheet P so as to fix the toner images on the transferring sheet P. After the toner images are fixed, the transferring sheet P is discharged onto the discharged-sheet tray (not shown). In this way, a full-color image is formed on the surface of the transferring sheet P.

Figure 2:
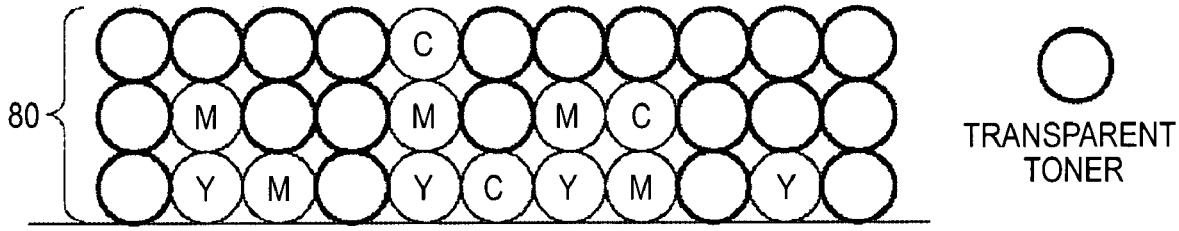
FIG. 2 illustrates how a transparent toner flattens the surface of color toner layers.

FIG. 2 is a schematic sectional view showing a layer of toner formed on a recording sheet by the image forming apparatus of the present embodiment. In FIG. 2, reference numeral 80 denotes the layers of the toners. From the viewpoint of the offset occurring in fixing, the maximum amount of color toners (yellow, magenta, cyan, and black toners) is 1.0 mg/cm$^2$, and the maximum amount of each color toner is 0.5 mg/cm$^2$. Transparent toner is added to the parts where the amount of color toner is small so that the sum of the amounts of color toners and transparent toner is 1.0 mg/cm$^2$. In this way, the amount of toner per unit area becomes uniform throughout the image, and therefore the gloss becomes uniform throughout the image. As is known, the gloss of the image is equalized by eliminating the irregularity in thickness of toner layer, that is to say, the difference in the amount of toner per unit area.

When the amount of toner per unit area is equalized as described above, transparent toner is placed also in the non-image part. However, the amount of toner in the non-image part need not be exactly the same as that in the image part. The uniformity of gloss is improved by just placing transparent toner in the non-image part. When transparent toner is placed in the non-image part, even if the amount of toner per unit area is not uniform, the present invention can be applied.

In the present invention, the difference between transparent toner and color toners is the presence or absence of colorant. Toner is mainly made of resin (e.g., styrene-acrylic resin). In the case of color toners, colorant (e.g., pigment or dye) is added. In contrast, in the case of transparent toner, colorant is not added. However, in order to control charging, a small amount of colorant can be added as long as the colorant does not affect the function of the transparent toner. In general, external additive is added to toners in order to give various characteristics. External additive can be added also to transparent toner. The external additive added to transparent toner can have the same composition as the external additive added to color toners. In this case, if transparent toner is mixed with a color toner, a negative effect can be minimized.

The characteristic parts of the present invention will be described in detail.

A characteristic point of the present invention is that color toner stations (yellow, magenta, cyan, and black toner stations) are not provided with cleaners for removing residual toner on the photoconductor drums (cleanerless structure) and only a transparent toner station is provided with a cleaner for removing residual toner on the photoconductor drum. The structure and operation will be described.

First, the structure of the color toner stations (yellow, magenta, cyan, and black toner stations) will be described. The color toner stations have the same structure. In the following description, the photoconductor drums 1*a*, 1*b*, 1*c*, and 1*d*, the charging devices 2*a*, 2*b*, 2*c*, and 2*d*, the exposing devices 3*a*, 3*b*, 3*c*, and 3*d*, the developing devices 4*a*, 4*b*, 4*c*, and 4*d*, the first transferring rollers 5*a*, 5*b*, 5*c*, and 5*d*, and charging assisting brushes 6*a*, 6*b*, 6*c*, and 6*d* will be simply referred to as photosensitive drum 1, charging device (roller) 2, exposing device 3, developing device 4, first transferring roller 5, and charging assisting brush 6, respectively, when there is no need to particularly distinguish colors of toner.

Figure 3:
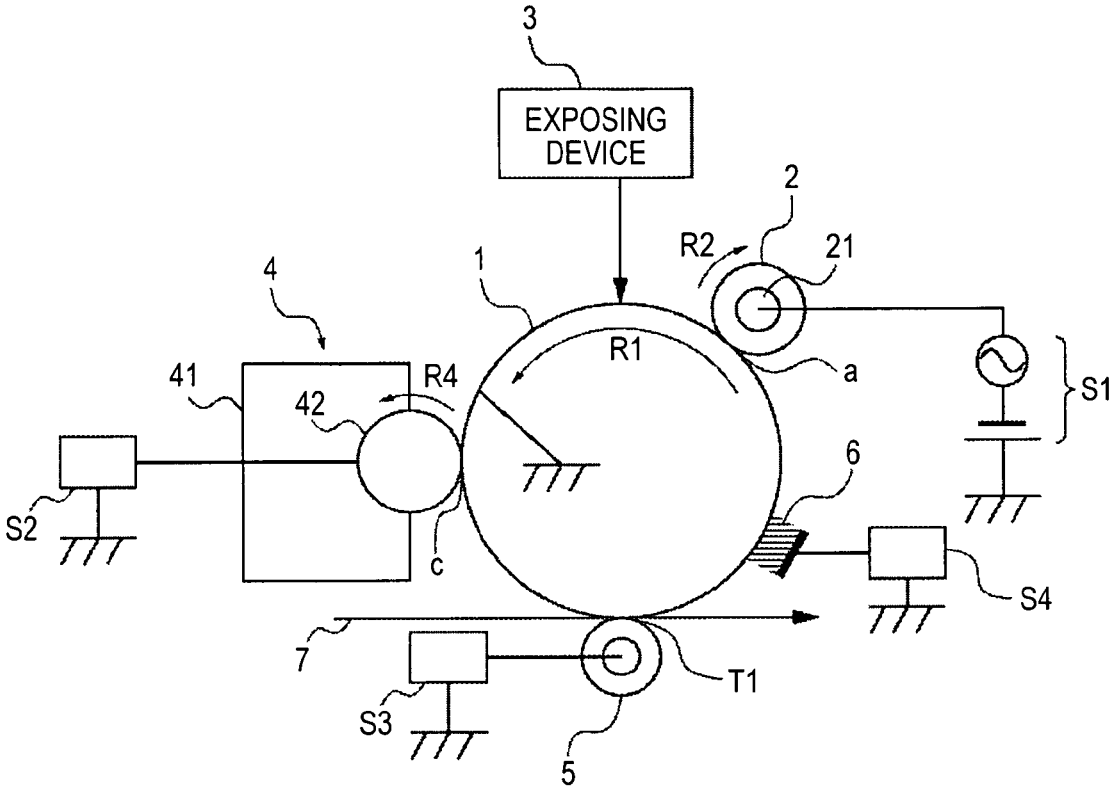
FIG. 3 illustrates a color toner station.

FIG. 3 is an enlarged view showing the photoconductor drum 1 and the vicinity of the photoconductor drum 1. The charging roller 2 (contact charging device), the exposing device 3, the developing device 4, the first transferring roller 5, and the charging assisting brush 6 are disposed around the photoconductor drum 1. The charging roller 2, the exposing device 3, the developing device 4, the first transferring roller 5, and the charging assisting brush 6 are arranged in this order in the direction of rotation of the photoconductor drum 1 (the direction of arrow R1).

(1) Photoconductor Drum (Image Carrier)

The color toner station according to embodiment 1 includes the photoconductor drum 1 serving as an image carrier. This photoconductor drum 1 has a photoconductive layer formed of OPC (organic photoconductor) having negative charging characteristics. The photoconductor drum 1 is 50 mm in diameter and rotated around a rotating shaft (not shown) at a processing speed (circumferential speed) of 100 mm/sec in the direction of arrow R1.

(2) Charging Roller (Contact Charging Member)

The color toner station shown in FIG. 3 has the charging roller 2 (contact charging member) serving as a charging device. The charging roller 2 evenly charges the surface (circumferential surface) of the photoconductor drum 1 so that the surface has a predetermined polarity and potential.

As shown in FIG. 3, the charging roller 2 is rotatable. Both ends of the core metal 21 of the charging roller 2 are supported by bearings (not shown). The bearings are urged toward the photoconductor drum 1 by a pressing spring (compression spring, not shown) serving as an urging member. The charging roller 2 is thereby pressed against the surface of the photoconductor drum 1 at a predetermined pressure. Thus, a charging part (charging nip) a is formed between the photoconductor drum 1 and the charging roller 2. Driven by the photoconductor drum 1, the charging roller 2 rotates in the direction of arrow R2 with the rotation of the photoconductor drum 1 in the direction of arrow R1.

A first power source S1 applies a charging bias to the charging roller 2. That is to say, the first power source S1 applies an oscillatory voltage to the core metal 21 of the charging roller 2. The oscillatory voltage (charging bias) is a superposition of a direct current voltage and an alternating current voltage. The charging roller 2 uniformly charges the surface of the rotating photoconductor drum 1 at a predetermined polarity and potential. A discharge current controller (not shown) detects the amount of discharge current between the charging roller 2 and the photoconductor drum 1. On the basis of the detected amount of discharge current, the controller controls the first power source S1 so as to minimize the amount of current used for charging. Incidentally, the above-mentioned alternating voltage means any voltage that changes the amplitude with time such as a sine wave, a rectangular wave, or a triangular wave.

(3) Exposing Device (Information Writing Device)

The color station in FIG. 3 has the exposing device 3 serving as an information writing device. The exposing device 3 forms an electrostatic latent image on the charged surface of the photoconductor drum 1. In the present embodiment, the exposing device 3 is a laser beam scanner using a semiconductor laser.

(4) Developing Device

The developing device 4 supplies developer (toner) to the electrostatic latent image on the photoconductor drum 1 so as to make the electrostatic latent image into a visible toner image. In the present embodiment, the developing device 4 is a reversal developing device using a two-component magnetic brush developing method.

The developing device 4 includes a developer container 41 and a developing sleeve 42.

The developer container 41 contains a two-component developer. The two-component developer is a mixture of toner and magnetic carrier. In the present embodiment, the resistance of the magnetic carrier is about $10^{13}$ Ω·cm, and the particle diameter thereof is 40 μm. The toner is negatively charged by friction with the magnetic carrier.

The developing sleeve 42 is disposed so as to face the photoconductor drum 1, such that the shortest distance of gap (S-D gap) between the developing sleeve 42 and the photoconductor drum 1 is 350 μm. Reference character c denotes a developing part where the photoconductor drum 1 and the developing sleeve 42 face each other. The developing sleeve 42 is driven to rotate such that the surface thereof moves in the opposite direction from that of the surface of the photoconductor drum 1 in the developing part c. That is to say, while the photoconductor drum 1 rotates in the direction of arrow R1, the developing sleeve 42 rotates in the direction of arrow R4.

The developing sleeve 42 has a magnetic roller in the inside. Attracted by the magnetic force of the magnetic roller, the two-component developer is conveyed to the developing part c with the rotation of the developing sleeve 42. A magnetic brush layer is made into a thin layer having a predetermined thickness by a developer coating blade (not shown). A second power source S2 applies a predetermined developing bias to the developing sleeve 42. In the present embodiment, the developing bias applied to the developing sleeve 42 is an oscillatory voltage that is a superposition of a direct current voltage (Vdc) and an alternating current voltage (Vac). More specifically, the direct current voltage is −350 V, and the alternating current voltage is 1600 V. Due to an electric field of the developing bias, the toner in the two-component developer selectively adheres to the surface of the photoconductor drum 1 in response to the electrostatic latent image thereon. In this way, the electrostatic latent image is developed into a toner image.

At this time, the charge amount of the toner used for development on the photoconductor drum 1 is −25 μC/g.

After passing the developing part c, the developer on the developing sleeve 42 returns to a developer reservoir inside the developer container 41 by the further rotation of the developing sleeve 42.

(5) Transferring Device

In the present embodiment, the transferring roller 5 is used as a transferring device. The transferring roller 5 is pressed against the surface of the photoconductor drum 1 at a predetermined pressure. Reference character T1 denotes the nip between the transferring roller 5 and the photosensitive drum 1 where transfer is performed. Held between the photoconductor drum 1 and the transferring roller 5, the intermediate transferring belt 7 is conveyed. A third power source S3 applies a transferring bias to the transferring roller 5. The transferring bias has a positive polarity (+2 kV in the present embodiment), which is a reverse polarity from the negative polarity, the normal charging polarity of the toner. By the application of the transferring bias, the toner image on the photoconductor drum 1 is sequentially transferred onto the intermediate transferring belt 7.

(6) Charging Assisting Brush

The charging assisting brush 6 is disposed on the downstream side of the transferring part T1 and on the upstream side of the charging part a with regard to the rotating direction of the photoconductor drum 1. The charging assisting brush 6 serves as a charging assisting device and is pressed against the surface of the photoconductor drum 1. The charging assisting brush 6 is an electrically conductive brush, to which a fourth power source S4 applies an AC bias, a DC bias of reverse polarity from the charge, or a DC bias of reverse polarity from the charge on which an AC bias is superposed. Just before the charging by the charging roller 2, the charging assisting brush 6 evens out the charge on the surface of the photoconductor drum 1 so as to erase the former image. At the same time, the charging assisting brush 6 temporarily catches the residual toner in the brush, and then releases the residual toner onto the photoconductor drum 1.

The color toner station has the cleanerless structure and does not have a dedicated cleaner for removing the toner that is not transferred to the intermediate transferring belt 7 at the transferring nip T1 and remains on the surface of the photoconductor drum 1 (residual toner). The residual toner passes through the charging assisting brush 6 and is then carried to the charging part a by further rotation of the photoconductor drum 1. The residual toner temporarily adheres to the charging roller 2, which is pressed against the photoconductor drum 1. Next, the adhering toner is released onto the photoconductor drum 1. Finally, the toner is picked up by the developing device 4 at the same time as development.

If this so-called "retransfer" occurs, that is to say, if a toner of a station adheres to the image carrier of the next station, the retransferred toner passes through the charging assisting brush 6 and the charging roller 2, and is finally picked up by the developing device 4.

In the case where a color toner is mixed into another color toner contained in the developing device, the mixed toners are not placed in the non-image part because color toners are placed only in the image part. Therefore, in most cases, the mixed toners are unnoticeable and do not become a problem.

In contrast, in the case where the transparent toner station has the cleanerless structure as in the color toner stations, if mixing of toners due to retransfer occurs, color toners mixed into transparent toner are placed in the non-image part because transparent toner is placed also in the non-image part. The color toners placed in the non-image part are very noticeable like the so-called "fog" defect in an image.

To solve this problem, the transparent toner station can be located at the most upstream position so that no other toners come into the transparent toner station from the upstream side. In this case, if the image formation is carried out normally, indeed, no other toners come into the transparent toner station from the upstream side. However, if a paper jam occurs, the intermediate transferring belt must rotate repeatedly to remove the toner thereon. In this case, mixing of toners is inevitable. In addition, the order of image formation is limited, and therefore the advantageous effect of the transparent toner cannot be fully achieved.

The present invention is characterized in that the transparent toner station, which places transparent toner in the non-image part, is provided with a cleaner for picking up the retransferred toner.

Figure 4:
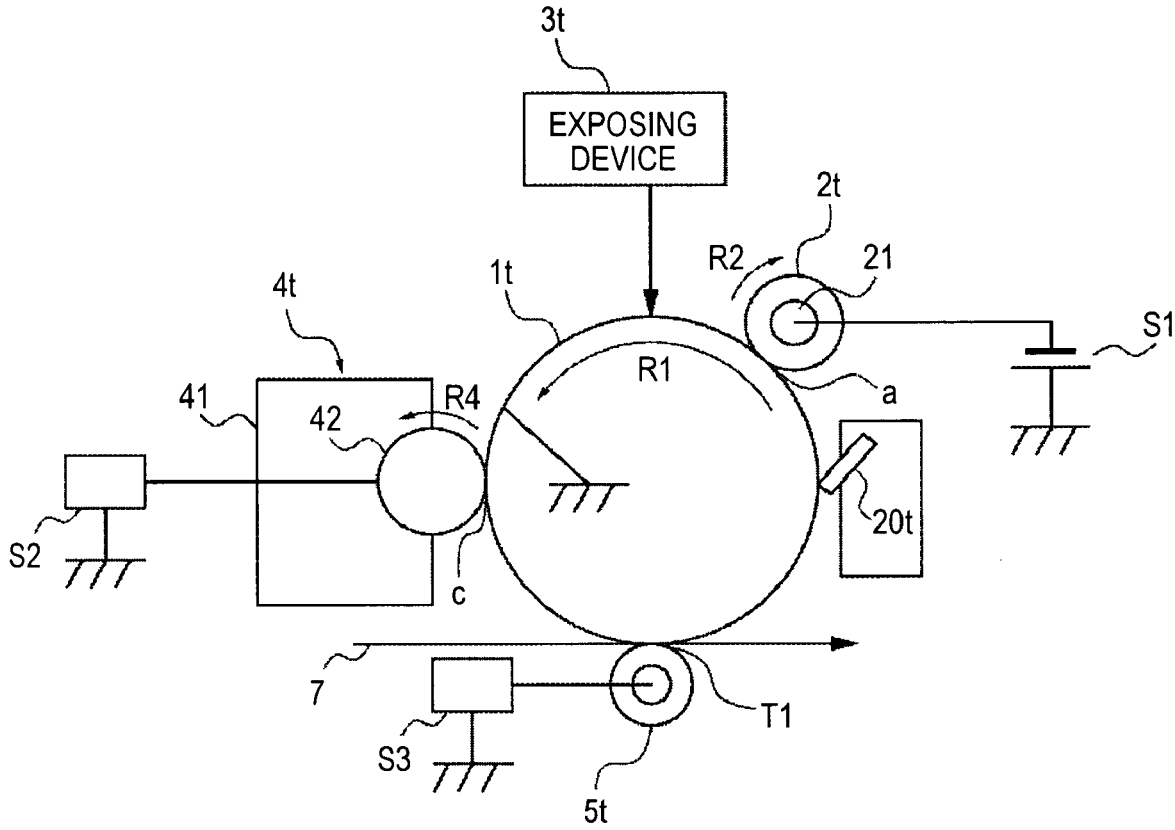
FIG. 4 illustrates a transparent toner station.

FIG. 4 shows an enlarged view of the photoconductor drum 1*t* of the transparent toner station and the vicinity of the photoconductor drum 1*t*. The charging roller 2*t* (contact charging member), the exposing device 3*t*, the developing device 4*t*, and the first transferring roller 5*t* are disposed around the photoconductor drum 1*t* in this order in the rotating direction (direction of arrow R1) of the photoconductor drum 1 as in the color toner stations. Unlike the color toner stations, the transparent toner station has a cleaning blade 20*t* instead of the charging assisting brush 6.

The charging roller 2*t*, the exposing device 3*t*, the developing device 4*t*, and the first transferring roller 5*t* are almost the same as those in the color toner stations, and therefore a detailed description will be omitted.

(7) Cleaning Device (Cleaning Blade)

In the present embodiment, the cleaning blade 20*t* is used as a cleaning device in the transparent toner station. The cleaning blade 20*t* is formed of an elastomer (e.g., polyurethane rubber). The cleaning blade 20*t* is pressed against the surface of the photoconductor drum 1 at a predetermined pressure. The cleaning blade 20*t* removes the residual transparent toner and the color toners retransferred from other stations.

As described above, providing the cleaning blade in the transparent toner station prevents other color toners from entering the developing device 4*t* of the transparent toner station due to retransfer.

On the other hand, since the transparent toner station has the cleaner, the transparent toner station cannot benefit from the cleanerless structure. That is to say, the transparent toner station has a problem where the surface of the photoconductor drum is gradually abraded with use because the cleaner is in contact with the photoconductor drum and therefore the life of the photoconductor drum is short compared with other stations.

To solve this problem, the following measures are taken in the present embodiment.

Since the color toner stations have the cleanerless structure, the photoconductor drums are not abraded by cleaners. However, since the color toner stations use the contact charging method (charging rollers), the photoconductor drums are abraded by the charging rollers.

As described above, the first power source S1 applies a voltage to the charging roller 2. The voltage is a superposition of an alternating current voltage (AC) and a direct current voltage (DC). Here, the alternating current voltage is an alternating component. When the photoconductor drum 1 is charged, a discharge current flows to the photoconductor drum 1 in response to changes in the alternating current voltage. These periodical changes in the discharge current enable stable charging of the photoconductor drum 1. On this account, in the present embodiment, the color toner stations use a charging method in which an alternating current voltage (AC) and a direct current voltage (DC) are superposed, in order to improve the image stability.

However, not all electrical energy of the discharge current is used for charging the photoconductor drum 1. Part of electrical energy of the discharge current electrically stimulates the polymeric material on the photoconductor drum 1. Therefore, a defect tends to occur in molecular binding of the polymeric material. The surface of the photoconductor drum 1 is gradually abraded by friction with use. It is known that the amount of abrasion by the charging roller 2 in the case of AC charging is larger than that in the case of DC charging. The DC charging uses only a direct current voltage (DC) is used. The AC charging uses a superposition of an alternating current voltage (AC) and a direct current voltage (DC). The peak-to-peak voltage Vpp of the AC is more than twice as high as the DC. In addition, since the current value changes periodically, the discharge current vibrates and stimulates the surface of the photoconductor drum. Therefore, the surface of the photoconductor drum tends to have a defect in the molecular binding.

As described above, since the color toner stations use the AC charging method, the color toner stations ensure charging stability, i.e., image stability. However, the amount of abrasion of the photoconductor drum due to charging is large. On the other hand, since the color toner stations have the cleanerless structure, there is no abrasion due to friction with cleaners.

In contrast, since the transparent toner station includes the cleaner, the photoconductor drum of the transparent toner station is abraded by the cleaner (cleaning blade). In the present embodiment, the transparent toner station uses the contact charging method using a charging roller as in the color toner stations. However, whereas a superposed AC voltage on a DC voltage is applied in the color toner stations, only a DC voltage is applied in the transparent toner station. Therefore, the amount of abrasion of the photoconductor drum by the charging roller is small compared with the color toner stations in which an alternating current voltage is applied.

The color toner stations use the AC charging method and have no cleaners. The transparent toner station uses the DC voltage charging method and includes the cleaner. The amount of abrasion of the photoconductor drum of the transparent toner station can be as much as that of each color toner station.

Since the transparent toner station uses the DC voltage charging method, the charging is less stable than the AC voltage charging method. However, even if the charging is less stable, the transparent toner is less influential in the image quality than the color toners because the transparent toner is mainly placed in the non-image part.

Figure 11:
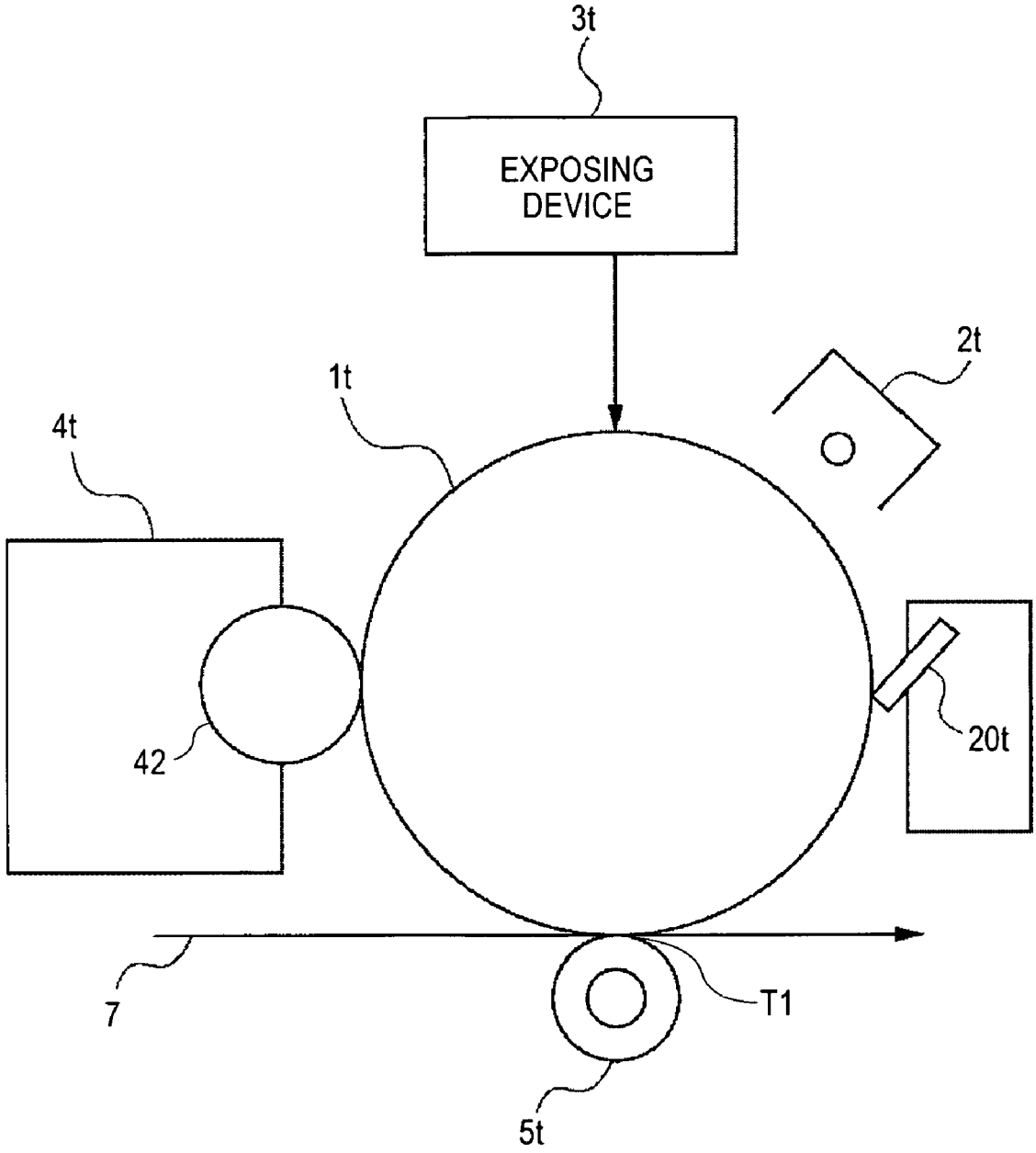
FIG. 11 illustrates a transparent toner station having a contactless charging device.

In the present embodiment, the transparent toner station uses the DC voltage charging method. However, in the case where the amount of abrasion by the cleaning device is small, if the Vpp (peak-to-peak) voltage of the superposed AC voltage is lower than that of the color toner stations, the transparent toner station can use the AC voltage charging method. In this case, abrasion due to charging can be reduced. In the case where the amount of abrasion by the cleaning device is large, as shown in FIG. 11, using a contactless charging method (e.g., corona charging) can reduce the amount of abrasion of the photoconductor drum by the charging device.

Figure 5:
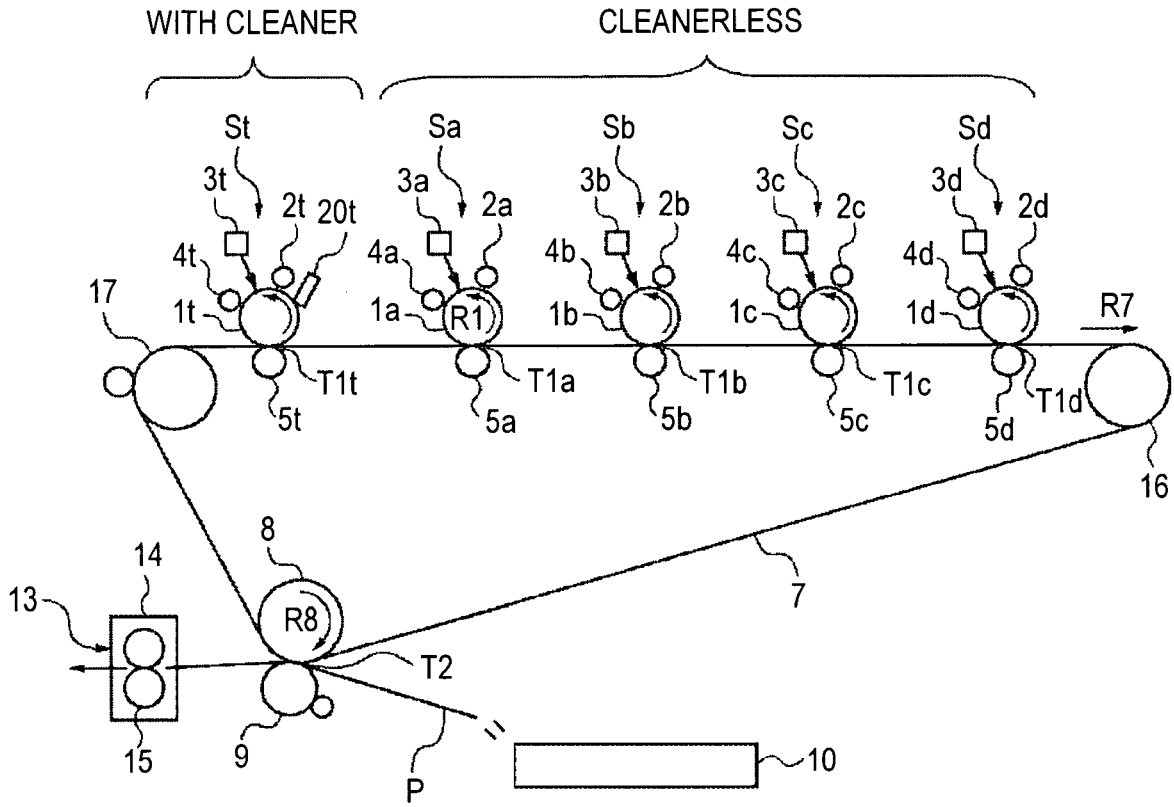
FIG. 5 illustrates an image forming apparatus according to another embodiment of the present invention.

In the present embodiment, the transparent toner station is disposed at the most downstream position. However, the position of the transparent toner station is not limited. The position of the transparent toner station can be changed in accordance with the intended use of the transparent toner. When the transparent toner station is disposed at the most upstream position as shown in FIG. 5, no toner is retransferred to the transparent toner station from the upstream side. Therefore, if defective cleaning occurs, the possibility that color toners are mixed into the transparent toner can be reduced in advance. However, as described above, in the case of a paper jam, the toner on the intermediate transferring belt is not transferred to the transferring sheet. Therefore, the toner needs to be removed with the belt cleaner. In the case of a solid image, the toner often cannot be removed in the first attempt. Therefore, the intermediate transferring belt 7 is rotated a number of times to repeat the cleaning operation. Therefore, even when the transparent toner station is disposed at the most upstream position, the possibility of color mixing due to retransfer remains. In order to completely prevent the color mixing, the transparent toner station needs to be provided with a cleaning device as in the present invention.

The intermediate transferring belt cleaner 12 removes the residual toner on the intermediate transferring belt 7 after the intermediate transferring belt 7 has passed through the second transferring nip T2. In the case where the transparent toner station is disposed at the most upstream position, the intermediate transferring belt cleaner 12 can be made unnecessary by using the cleaning blade 20*t* of the transparent toner station. That is to say, if the first transferring roller 5*t* applies the opposite bias from the normal bias at the first transferring nip T1*t* of the transparent toner station, the residual toner on the intermediate transferring belt is transferred to the photoconductor drum 1*t* of the transparent toner station and then picked up by the cleaning device 20*t* of the transparent toner station. In this case, since the image forming apparatus has no intermediate transferring belt cleaner, the image forming apparatus is more space-saving and more inexpensive.

As described above, in the first embodiment of the present invention, transparent toner is used for equalizing the gloss throughout the image. The color toner stations use the contact AC charging method to ensure charging stability and have no cleaners (cleanerless structure) to prevent abrasion. The transparent toner station includes a cleaner to prevent deterioration in image quality due to color mixing and uses the DC charging method to prevent abrasion. Consequently, the image forming apparatus according to the present embodiment can prevent both deterioration in image quality and abrasion of the photoconductor drums even when transparent toner is used in the non-image part.

Embodiment 2

In embodiment 1, the method of charging is changed in order to prevent abrasion of the photoconductor drum of the transparent toner station by the cleaning device.

In embodiment 2, the transparent toner station has a different kind of photoconductor drum from the color toner stations in order to prevent abrasion.

According to the experimentations performed by the inventors, the amount of abrasion is found to be correlated with the elastic deformation rate of the surface layer of the photoconductor drum. The lower the elastic deformation rate, the smaller the elastic force of the photoconductor. The smaller the elastic force of the photoconductor, the more easily a defect due to friction occurs in the molecular binding on the surface of the photoconductor drum.

The present embodiment is characterized in that the elastic deformation rate of the surface layer of the transparent toner station is higher than the elastic deformation rate of the surface layers of the color toner stations.

The elastic deformation rate of a photoconductor can be changed by changing the material of the photoconductor. In the present embodiment, the photoconductor drum used in the transparent toner station is a so-called amorphous photoconductor consisting mainly of amorphous silicon. In contrast, the photoconductor drums used in the color toner stations are conventional OPCs.

In the present embodiment, the elastic deformation rate of the OPCs used in the color toner stations is about 40. In contrast, the elastic deformation rate of the amorphous photoconductor is about 70. Therefore, although the transparent toner station uses a cleaning blade, the amount of abrasion of the photoconductor drum is the same as that of the color stations.

The elastic deformation rate can be measured by the use of the Fischerscope H100V. The Fischerscope H100V is a minute hardness measuring apparatus that continuously applies a load to an indenter and directly reads the indentation depth under a load so as to obtain continuous hardness. A Vickers pyramidal diamond indenter having an angle of 136 degrees between the opposite faces can be used as the indenter. The elastic deformation rate is measured in a stepwise manner (273 stepwise measurements, each step having a holding time of 0.1 seconds) until a final load of 6 mN is applied.

Figure 6:
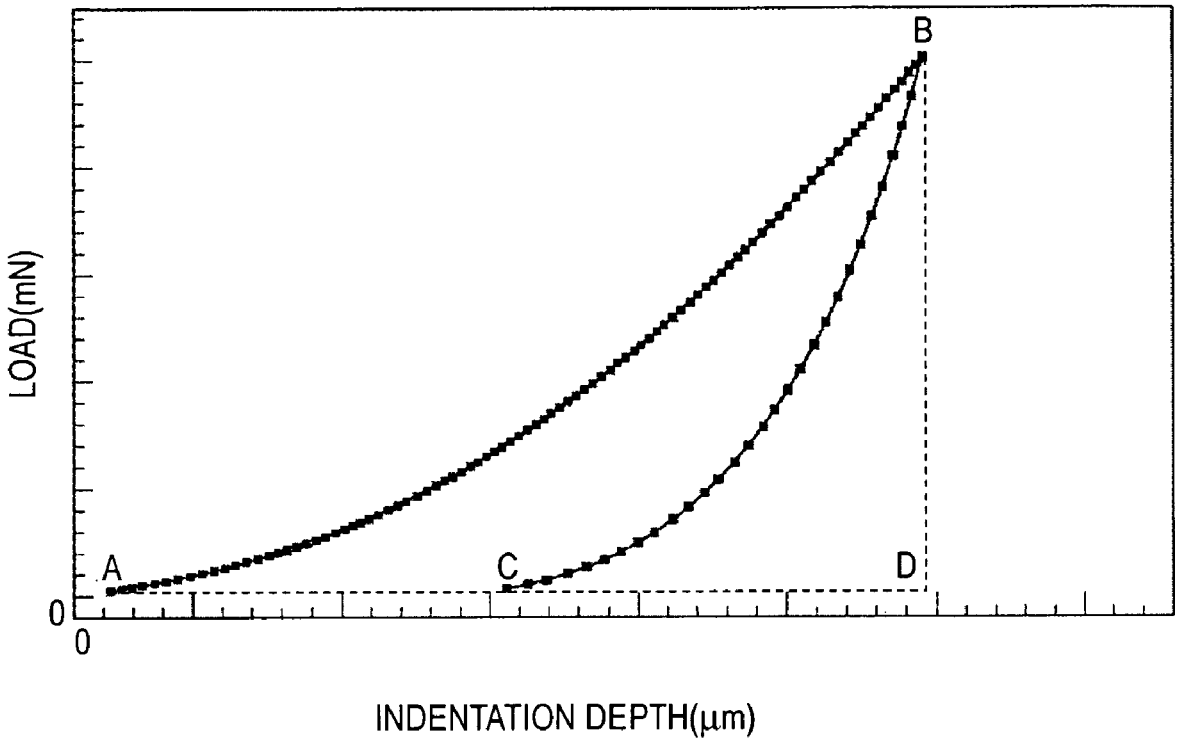
FIG. 6 shows a schematic output chart of a Fischerscope H100V (produced by Fischer Corp.)

FIG. 6 shows a schematic output chart of the Fischerscope H100V (produced by Fischer Corp.) In FIG. 6, the vertical axis represents the load (mN) and the horizontal axis represents the indentation depth (μm). In the measurement shown in FIG. 6, the load was increased in a stepwise manner up to 6 mN, and then decreased in a stepwise manner in the same way.

The elastic deformation rate is calculated based on a workload (energy) applied by the indenter on the film, in other words, the change in energy due to increasing and decreasing of the load applied by the indenter on the film. The value of the elastic deformation rate is calculated by the following equation (1):

$$\text{Elastic deformation rate} = We/Wt \quad (1)$$

where Wt (nJ) represents a total workload indicated by the area surrounded by A-B-D-A in FIG. 6, and We (nJ) represents a workload for elastic deformation indicated by the area surrounded by C-B-D-C in FIG. 6.

The "surface layer" in the present invention means a layer that constitutes a photoconductive layer of the photoconductor and is located on the surface of the electrophotographic photoconductor. The photoconductive layer can be a single layer that contains a charge-generating material and a charge-transporting material (hereinafter referred to as "single layer type"). Alternatively, the photoconductive layer can be a mutilayer including a charge-generating layer containing a charge-generating material and a charge-transporting layer containing a charge-transporting material (hereinafter referred to as "multilayer type"). The photoconductive layer is desirably the multilayer type. In the case where a photoconductive layer is the above-described single layer type, the "surface layer" in the present invention corresponds to the single layer. In the case where a protective layer is provided on the single layer, the "surface layer" in the present invention corresponds to the protective layer. In the case where a photoconductive layer is the above multilayer type, the "surface layer" in the present invention corresponds to the charge-transporting layer. In the case where a protective layer is provided on the charge-transporting layer, the "surface layer" in the present invention corresponds to the protective layer.

Thus, the abrasion of the photoconductor drum of the transparent toner station can be prevented.

Embodiment 3

In embodiment 3, the photoconductor drum of the transparent toner station has a different diameter from that of the photoconductor drums of the color toner stations in order to prevent abrasion.

Figure 7:
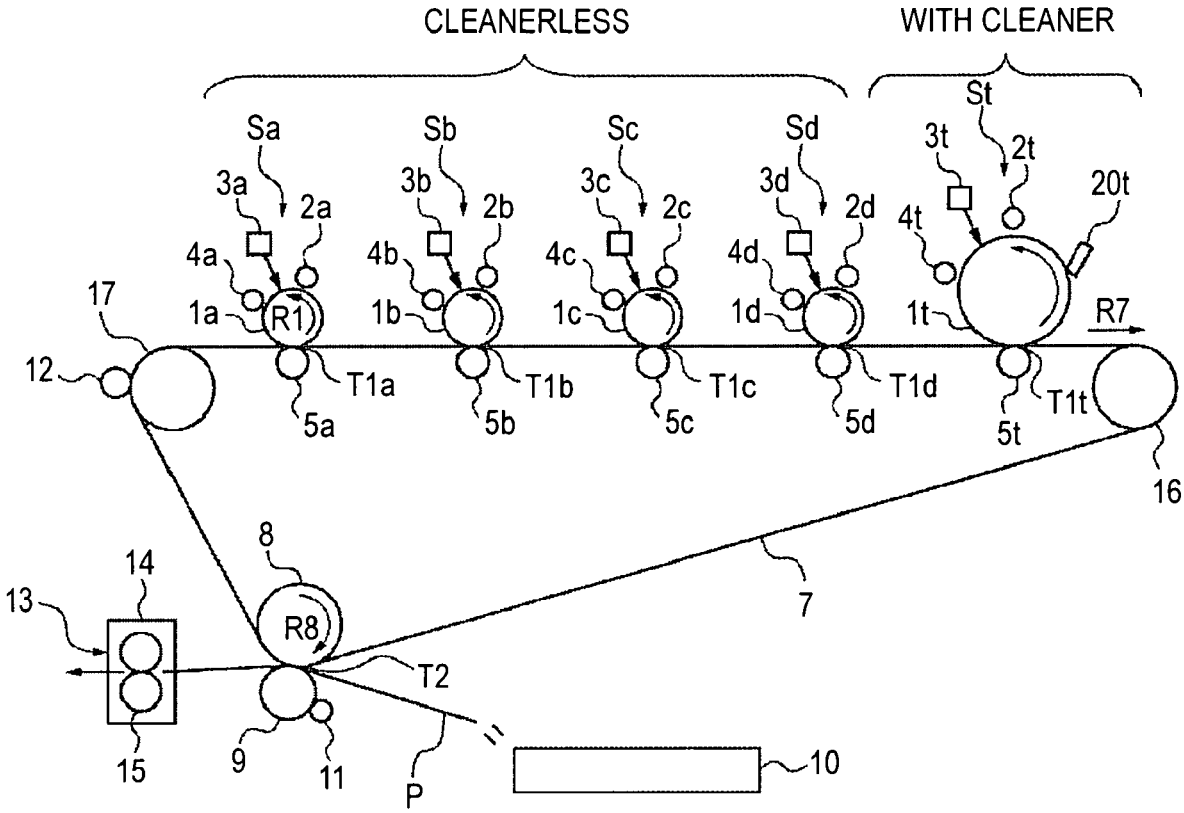
FIG. 7 illustrates an image forming apparatus according to another embodiment of the present invention.

FIG. 7 illustrates an image forming apparatus of the present embodiment. Although the image forming apparatus is almost the same as embodiment 1, the image forming apparatus is characterized in that the diameter of the photoconductor drum of the transparent toner station is larger than the diameter of the photoconductor drums of the color toner stations.

In the present embodiment, the diameter of the photoconductor drums of the color toner stations is 50 mm as in embodiments 1 and 2. In contrast, the diameter of the photoconductor drum of the transparent toner station is 100 mm. Consequently, the circumference of the photoconductor drum of the transparent toner station is twice as long as the circumference of the photoconductor drums of the color toner stations. The deterioration of the photoconductor drums is mainly caused by the change in molecular binding due to electrical discharge at the charging roller part and the friction with the cleaning blade. Since the circumference of the photoconductor drum is twice as long, the frequency of contacts per unit area of the photoconductor drum with the charging roller or the cleaning blade is ½, and consequently the life of the photoconductor drum is twice as long.

Thus, the abrasion of the photoconductor drum of the transparent toner station can be prevented.

Embodiment 4

Figure 8:
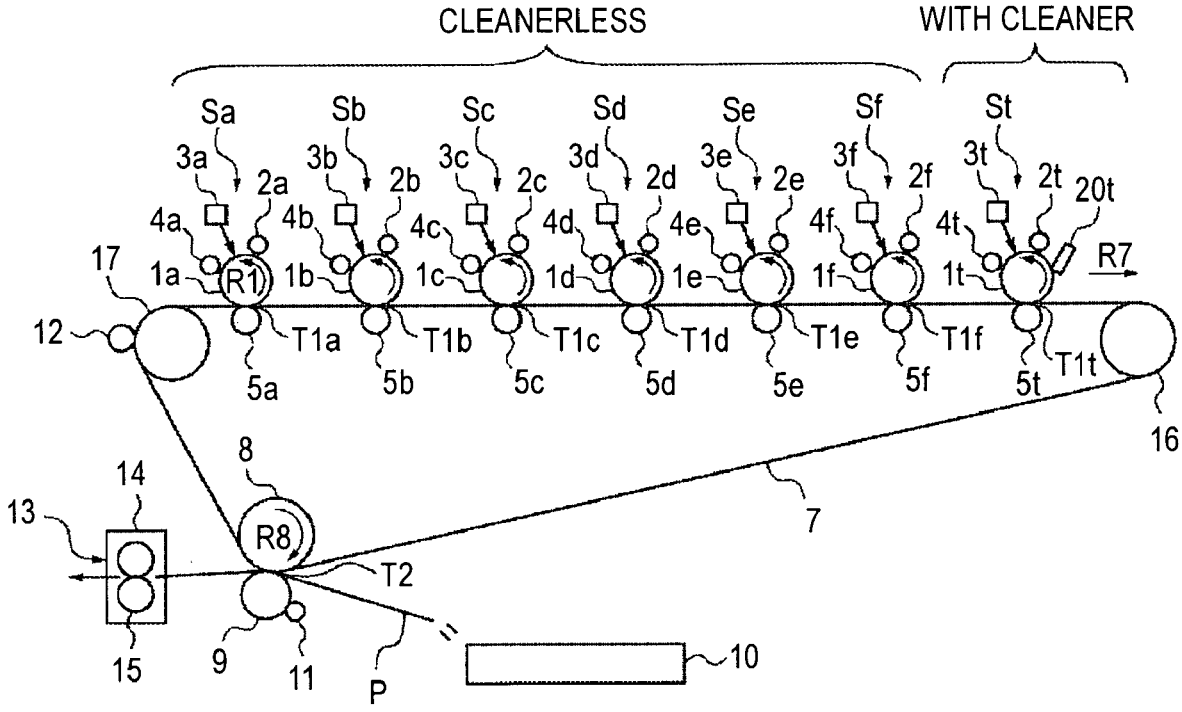
FIG. 8 illustrates an image forming apparatus according to another embodiment of the present invention.
Figure 9:
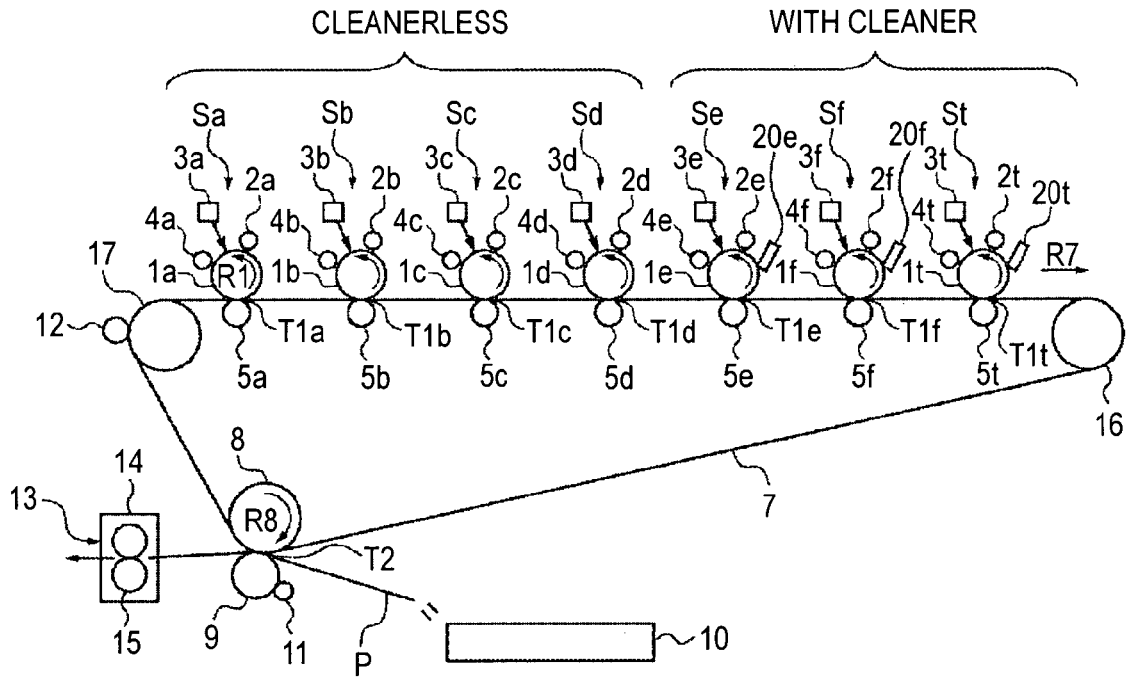
FIG. 9 illustrates an image forming apparatus according to another embodiment of the present invention.
Figure 10:
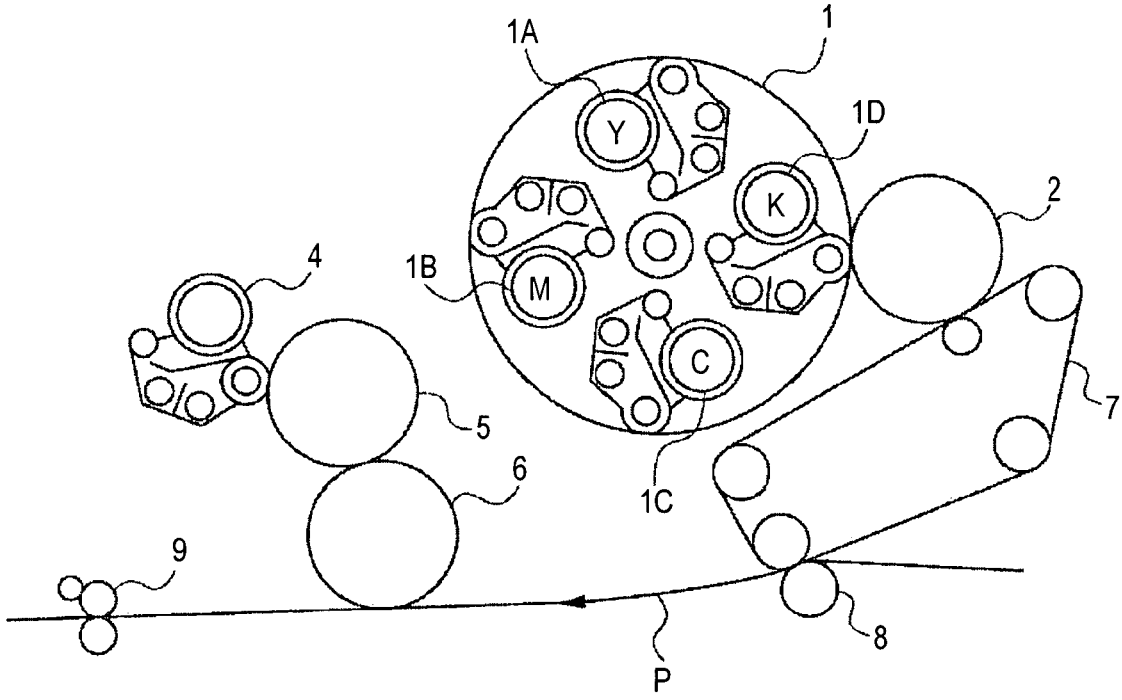
FIG. 10 PRIOR ART
FIG. 10 illustrates a conventional image forming apparatus.

FIGS. 8 and 9 illustrates image forming apparatuses of embodiment 4. The image forming apparatuses of the present embodiment have more image forming stations than embodiment 1. The image forming apparatuses have seven stations Sa, Sb, Sc, Sd, Se, Sf, and St. The stations Sa, Sb, Sc, Sd, and St use yellow, magenta, cyan, black, and transparent toners, respectively, as in embodiment 1. The stations Se and Sf use light magenta and light cyan toners, respectively. The light magenta and light cyan toners will be hereinafter referred to as "light color toners." The light color toners are designed so that the optical density after fixation is about 0.8 when the amount of toner placed on the transferring sheet is 0.5 mg/cm$^2$. The yellow, magenta, cyan, and black toners will be hereinafter referred to as "deep color toners." The deep color toners are designed so that the optical density after fixation is about 1.6 when the amount of toner placed on the transferring sheet is 0.5 mg/cm$^2$.

The pigments of the light color toners can be adjusted so that the optical density is less than 1.0 when the amount of toner placed on the transferring sheet is 0.5 mg/cm$^2$. The pigments of the deep color toners can be adjusted so that the optical density is greater than or equal to 1.0 when the amount of toner placed on the transferring sheet is 0.5 mg/cm$^2$.

The light color toners are mainly used for the purpose of reducing granularity of a low-density image. In order to improve granularity of a low-density image, it is necessary to make the image dots less noticeable. However, if the size of the dots is decreased, reproducibility of the dots is worsened. To solve this problem, light color toners are used. That is to say, instead of decreasing the size of the dots, the color density of the dots is decreased. In the case where the image density is low and the dots are noticeable, mainly light color toners are used to reduce granularity. In the case where the high image density is necessary, mainly deep color toners are used.

All deep colors may have their respective light color toners. However, in most cases, only colors in which granularity is noticeable have their respective light color toners. In the present embodiment, only magenta and cyan, in which granularity is particularly noticeable, have light magenta toner and light cyan toner, respectively.

When the present invention is applied to such a configuration, as in embodiment 1, the deep color toner stations Sa to Sd have no cleaning blades (cleanerless structure), and the transparent toner station St has a cleaning blade 20*t*.

The light color toner stations Se and Sf can have the cleanerless structure because the light color toners are not used in the non-image part and therefore the color mixing problem is less serious compared with the transparent toner. FIG. 8 shows such an example. In the image forming apparatus shown in FIG. 8, the color toner stations Sa to Sf have the cleanerless structure regardless of whether they use deep color toner or light color toner, and the transparent toner station has a cleaner.

The light color toners have the advantage of being unnoticeable compared with the deep color toners, although the light color toners have a slightly less charging stability compared with the deep color toners. The reason is as follows. The light color toners have a smaller optical density than that of the deep color toners, when the amount of toner placed on the transferring sheet is equal. Therefore, the variation of image density on the transferring sheet of the light color toners is smaller than that of the deep color toners, when the variation of charging potential is equal. Considering that the color mixing problem is more important than the charging stability, the transparent toner station includes a cleaner. For the same reason, the light color toner stations Se and Sf can be provided with cleaning blades 20*e* and 20*f*, respectively. FIG. 9 shows such an example. In the image forming apparatus shown in FIG. 9, the deep color toner stations Sa to Sd have the cleanerless structure, and the light color toner stations and the transparent toner station include cleaners. When a deep color toner is mixed into a light color toner, the deep color toner is noticeable due to great difference in the brightness. Based on this standpoint, providing the light color toner stations with cleaning blades is also advantageous.

An image forming apparatus can adopt the configuration of FIG. 8 or the configuration of FIG. 9 in response to the required size or performance. For example, when the configuration of FIG. 8 is used, the number of cleaning blades can be reduced, and therefore the image forming apparatus is space-saving. On the other hand, when the configuration of FIG. 9 is used, the deterioration in image quality due to color mixing and instability of charging can be controlled in a balanced manner by making use of the property of the light color toners.

In general, charging stability is important for the deep color toners, in which the pigment is adjusted so that the optical density is greater than or equal to 1.0 when the amount of toner on the transferring sheet is 0.5 mg/cm$^2$, and therefore the deep color toner stations have cleaners. As for the light color toner stations using light color toners, in which the pigment is adjusted so that the optical density is less than 1.0 when the amount of toner on the transferring sheet is 0.5 mg/cm$^2$, the cleanerless structure or the structure including cleaners can be used in response to the size or performance required for the image forming apparatus. The transparent toner station, which places transparent toner in the non-image part, has a cleaner as described above.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2004-360032 filed Dec. 13, 2004, which is hereby incorporated by reference herein in its entirety.

What is claimed is:

1. An image forming apparatus comprising:

a plurality of image forming stations, each including an image carrier for carrying an electrostatic image and a developing device for developing the electrostatic image with toner; and a transferring device for transferring toner images formed by the plurality of image forming stations to a transferring medium, wherein the plurality of image forming stations include a transparent image forming station using transparent toner and color image forming stations, wherein the transparent image forming station includes a cleaning device that is in contact with the image carrier and picks up residual toner on the image carrier, and wherein the developing devices of the color image forming stations develop electrostatic images on the corresponding image carriers and simultaneously pick up residual toners on their respective image carriers.

2. The image forming apparatus according to claim 1, wherein the transparent image forming station forms a transparent toner image in a non-image area.

3. The image forming apparatus according to claim 1, wherein the plurality of image forming stations include charging devices for charging their respective image carriers, and wherein the charging device of the transparent image forming station has a charging condition different from a charging condition of the charging devices of the color image forming stations.

4. The image forming apparatus according to claim 3, wherein the peak-to-peak value of alternating current component of a voltage applied to the charging device of the transparent image forming station is less than that of voltages applied to the charging devices of the color image forming stations.

5. The image forming apparatus according to claim 3, wherein the voltage applied to the charging device of the transparent image forming station has no alternating current component, and the voltages applied to the charging devices of the color image forming stations have an alternating current component.

6. The image forming apparatus according to claim 3, wherein the charging device of the transparent image forming station uses a contactless charging method, and the charging devices of the color image forming stations uses a contact charging method.

7. The image forming apparatus according to claim 1, wherein an elastic deformation rate of a surface layer of the image carrier of the transparent image forming station is greater than an elastic deformation rate of surface layers of the image carriers of the color image forming stations.

8. The image forming apparatus according to claim 1, wherein a circumference of the image carrier of the transparent image forming station is longer than a circumference of the image carriers of the color image forming stations.

9. The image forming apparatus according to claim 1, wherein the color image forming stations include four color image forming stations using yellow, magenta, cyan, and black toners, respectively.

10. The image forming apparatus according to claim 9, further comprising two additional color image forming stations using light magenta and light cyan toners, respectively.

* * * * *

UNITED STATES PATENT AND TRADEMARK OFFICE

CERTIFICATE OF CORRECTION

PATENT NO. : 7,321,741 B2 
APPLICATION NO. : 11/295505
DATED : January 22, 2008
INVENTOR(S) : Tomoyuki Sakamaki et al.

It is certified that error appears in the above-identified patent and that said Letters Patent is hereby corrected as shown below:

ON THE TITLE PAGE:

At Item (56), References Cited, Foreign Patent Documents, Line 4, "2003107836 A" should read --2003-107836 A-- and Line 5, "2003162125 A" should read --2003-162125 A--.

COLUMN 13:

Line 34, "illustrates" should read --illustrate--.

COLUMN 15:

Line 21, "include" should read --includes--.
Line 35, "include" should read --includes--.

COLUMN 16:

Line 18, "uses" should read --use--.

Signed and Sealed this

Nineteenth Day of August, 2008

JON W. DUDAS
*Director of the United States Patent and Trademark Office*